US006655368B2

(12) United States Patent
Wada

(10) Patent No.: US 6,655,368 B2
(45) Date of Patent: Dec. 2, 2003

(54) IGNITION COIL ASSEMBLY FOR ENGINE

(75) Inventor: Jyunichi Wada, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/420,865

(22) Filed: Apr. 23, 2003

(65) Prior Publication Data

US 2003/0200959 A1 Oct. 30, 2003

(51) Int. Cl.[7] ..... F02P 15/08
(52) U.S. Cl. ..... 123/635; 123/634; 123/647
(58) Field of Search ..... 123/635, 634, 123/647, 594

(56) References Cited

U.S. PATENT DOCUMENTS 6,543,430 B2 * 4/2003 Moga et al. ..... 123/634

FOREIGN PATENT DOCUMENTS

JP A-9-250437 9/1997

* cited by examiner

*Primary Examiner*—Bibhu Mohanty
(74) *Attorney, Agent, or Firm*—Nixon & Vanderhye P.C.

(57) ABSTRACT

In an ignition coil assembly, a plurality of ignition coils is arranged to be electrically connected to spark plugs received in plug holes of an engine, and a base member detachably engages and holds the ignition coils at corresponding positions, which correspond to positions of the plug holes. Disengaging force for disengaging each ignition coil and the base member from each other is set to be smaller than disengaging force for disengaging each ignition coil and the corresponding one of the spark plugs from each other.

3 Claims, 7 Drawing Sheets

IGNITION COIL ASSEMBLY FOR ENGINE

CROSS REFERENCE TO RELATED APPLICATION

This application is based on and incorporates herein by reference Japanese Patent Application No. 2002-128095 filed on Apr. 30, 2002.

BACKGROUND OF THE INVENTION

1. Field of the Invention

The present invention generally relates to an ignition coil device for an engine of, for example, an automobile and more specifically to an ignition coil assembly that includes a plurality of ignition coils, which are connected to corresponding spark plugs securely installed in plug holes of the engine.

2. Description of Related Art

For example, Japanese Unexamined Patent Publication No. 9-250437 discloses an integrated connector block, in which connectors for supplying electricity to corresponding ignition coils are integrated. The integrated connector block includes a connector block main body, which is formed as an elongated body made of a resin material. Coil connectors are integrally formed in a lower surface of the connector block main body. Each ignition coil, which is secured to a corresponding spark plug installed in an engine, is installed to and is thus engaged with a corresponding one of the coil connectors in an axial direction of the corresponding ignition coil, i.e., in an axial direction of the corresponding spark plug.

Furthermore, in order to allow installation of the ignition coils to the plug holes of the engine in a single step, an ignition coil assembly, which includes a plurality of ignition coils arranged at predetermined intervals, has been proposed. For example, as shown in FIG. 7, one such ignition coil assembly 21 includes a resin base member 13 that holds a plurality of ignition coils 12 at corresponding positions, which correspond to positions of plug holes 131 of an engine 130. Each ignition coil 12 may be threadably secured to the base member 13 through use of a bolt. Alternatively, each ignition coil 12 and the base member 13 may be integrally molded using a resin material. In either way, each ignition coil 12 and the base member 13 are integrated together. Thereafter, the ignition coil assembly 21 is installed to the engine 130 by axially installing the ignition coils 12 into the corresponding plug holes 131, and longitudinal ends of the base member 13 are secured to the engine 130 by bolts 13*c*.

In the previously proposed ignition coil assembly 21, all of the ignition coils 12 need to be simultaneously removed from the corresponding plug holes 131 of the engine 130 when one or more spark plugs need to be examined or replaced. This results in difficult work. That is, each ignition coil 12 is connected to the corresponding one of the spark plugs through a plug cap 12*d*. When all of the ignition coils 12 are simultaneously removed from the corresponding plug holes 131, the force required to remove all of the ignition coils 12 is equal to the product of the force for removing one ignition coil 12 multiplied by a number of the ignition coils 12. Thus, the removal operation of the ignition coils 12 becomes difficult, and, in some cases, it is impossible to remove the ignition coils 12.

SUMMARY OF THE INVENTION

The present invention addresses the above disadvantage. Thus, it is an objective of the present invention to provide an ignition coil assembly, which has a structure that allows easy removal of a base member from each ignition coil to allow easy maintenance work.

To achieve the objective of the present invention, there is provided an ignition coil assembly for an engine. The engine includes a plurality of plug holes, each of which receives a corresponding one of a plurality of spark plugs. The ignition coil assembly includes a plurality of ignition coils and a base member. The ignition coils are arranged to be electrically connected to the spark plugs, respectively. The base member detachably engages and holds the ignition coils at corresponding positions, which correspond to positions of the plug holes of the engine. Disengaging force for disengaging each ignition coil and the base member from each other is set to be smaller than disengaging force for disengaging each ignition coil and the corresponding one of the spark plugs from each other.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An embodiment of the present invention will be described with reference to the accompanying drawings.

An ignition coil assembly 1 according to the embodiment of the present invention is for an automobile engine and includes a plurality of ignition coils, which are arranged at predetermined intervals and are respectively axially connected to spark plugs securely received in plug holes of the engine.

Figure 1:
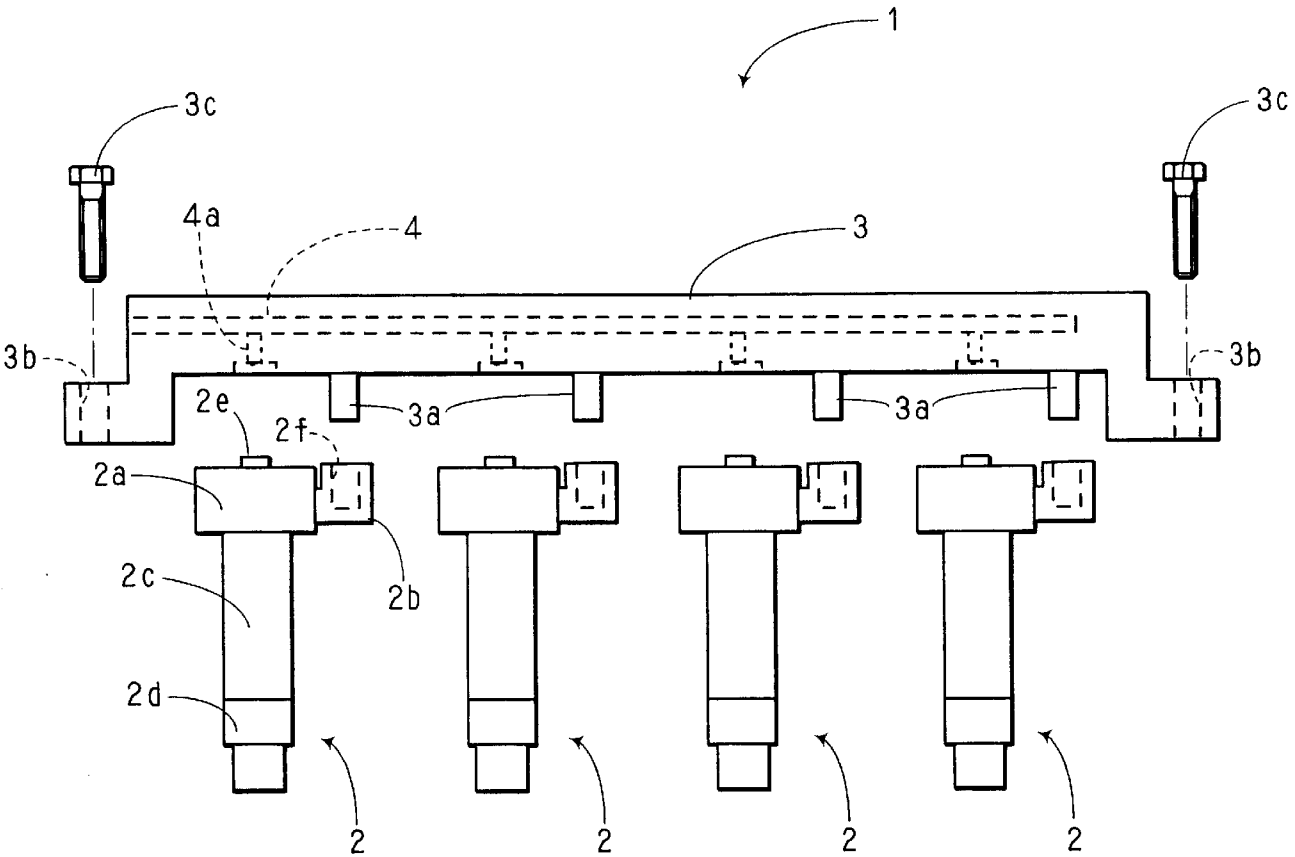
FIG. 1 is a schematic side view showing a state where ignition coils of an ignition coil assembly of an embodiment of the present invention are removed.
Figure 2:
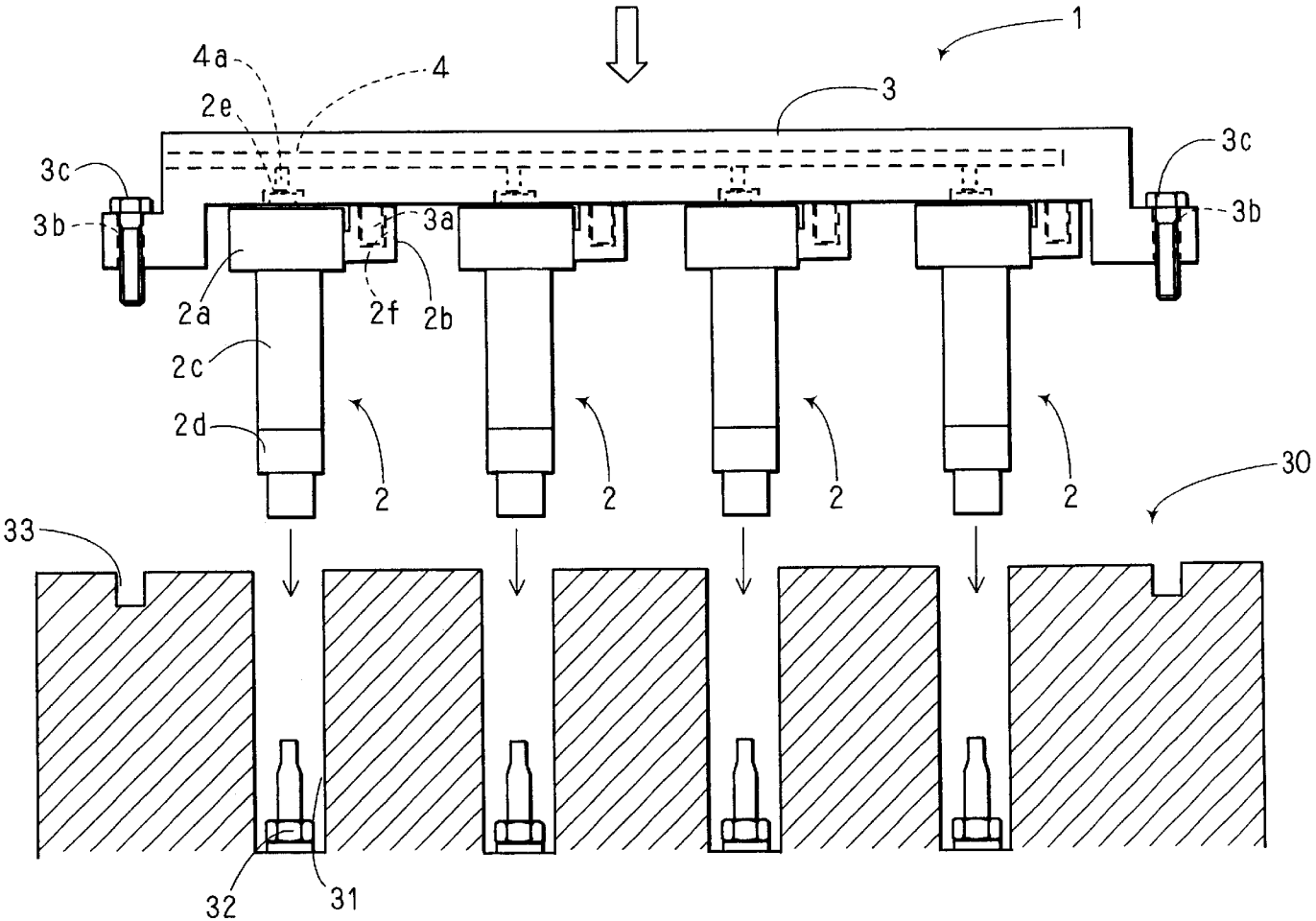
FIG. 2 is a schematic side view showing installation of the ignition coil assembly to an engine.
Figure 3:
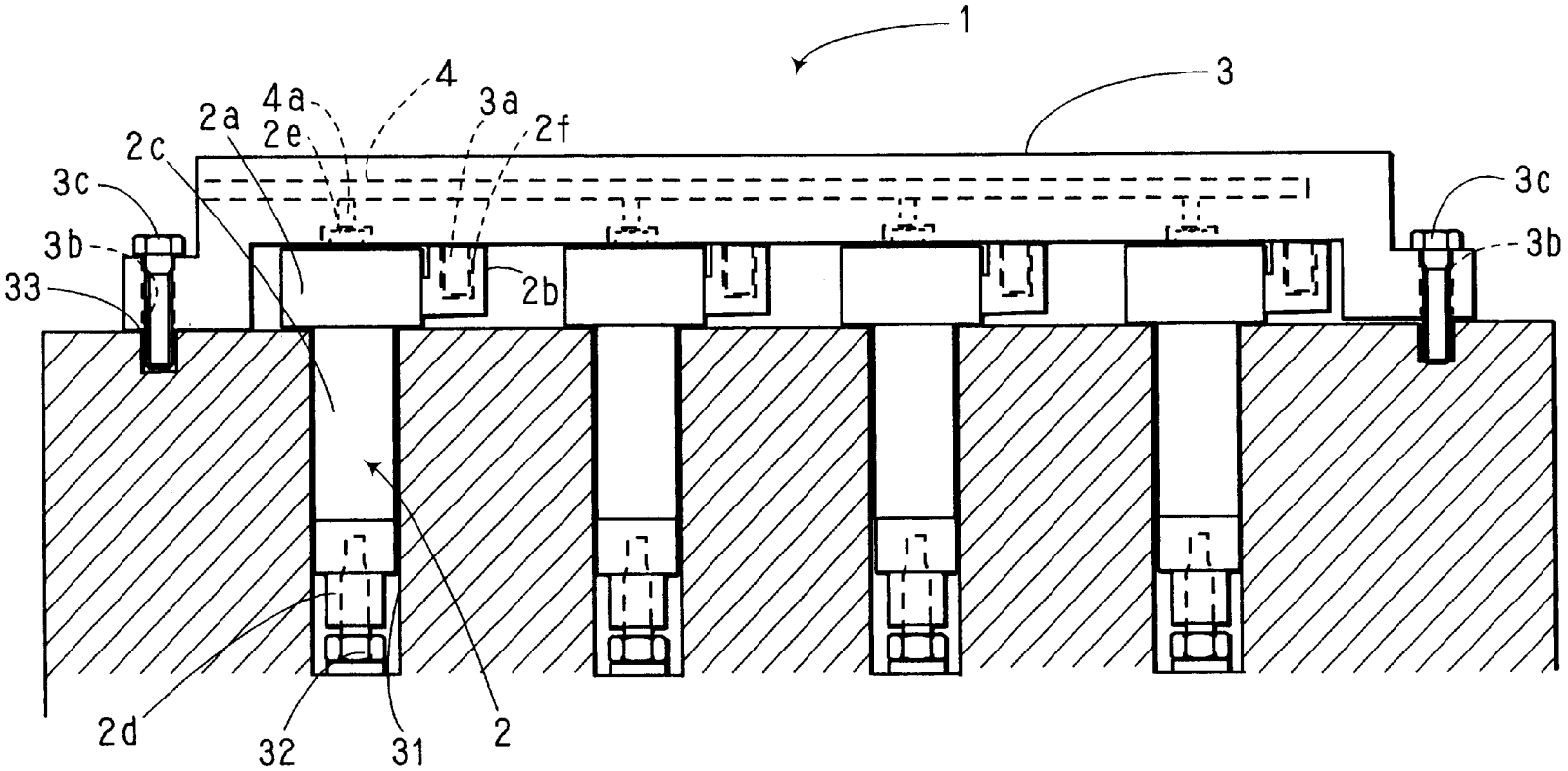
FIG. 3 is a schematic side view showing a state after installation of the ignition coil assembly to the engine.

That is, as shown in FIGS. 1 to 3, the ignition coil assembly 1 includes a plurality of ignition coils 2 and a base member 3, which detachably holds the ignition coils 2. It should be understood that the ignition coil assembly 1 shown in FIG. 1 is for a four cylinder engine and thus includes four ignition coils 2.

Each ignition coil 2 is formed as a stick shaped component that has a case, which is made of a dielectric resin material and receives an electric circuit for generating high voltage to be supplied to the corresponding spark plug. As shown in FIG. 1, each ignition coil 2 includes a head 2*a*, a connector 2*b*, a cylindrical main body 2*c* and a tubular plug cap 2*d*. The head 2*a* is arranged at the top end of the ignition coil 2. The connector 2*b* laterally projects from one side of the head 2*a*. The cylindrical main body 2*c* extends downwardly from the head 2*a*. The tubular plug cap 2*d* is connected to the lower end of the main body 2*c*.

The head 2*a* is formed as a generally cubic body. A size of the head 2*a*, i.e., a diameter of the circumcircle, which passes through all vertices of the head 2*a*in a plane that is perpendicular to the axis of the ignition coil 2, is greater than the inner diameter of a corresponding plug hole 31 of an engine 30. An electrical terminal 2*e* projects upwardly from a top surface of the head 2*a*. When each ignition coil 2 is installed to the base member 3, the terminal 2*e* of the head 2*a* engages a corresponding electrical terminal 4*a* of the base member 3 to form electrical connection therebetween.

The connector 2*b* is provided to mechanically connect the ignition coil 2 to the base member 3 and includes a recess 2*f*, which has an opening on its top side. A corresponding one of projections 3*a* of the base member 3 is fitted into the recess 2*f*.

The cylindrical main body 2*c* has an outer diameter smaller than the size of the head 2*a* and is inserted into the corresponding plug hole 31. Thus, each ignition coil 2 is installed to the engine 30 such that the main body 2*c* of the ignition coil 2 is inserted into the corresponding plug hole 31 of the engine 30, and the head 2*a* is placed over the top surface of the engine 30 around the corresponding plug hole 31.

The tubular plug cap 2*d* is formed as a tubular body made of a resilient material, such as a rubber material. When the ignition coil 2 is inserted into the corresponding plug hole 31, an inner peripheral surface of the plug cap 2*d* of the ignition coil 2 receives a top end of the corresponding spark plug 32 such that the ignition coil 2 and the spark plug 32 are connected to each other. Each of the plug cap 2*d* and the main body 2*c* has a corresponding internal engaging structure that allows secure engagement between the plug cap 2*d* and the main body 2*c* at the inside thereof. The plug cap 2*d* and the main body 2*c* are securely engaged with each other in a manner that prevents disengagement of the plug cap 2*d* from the main body 2*c* even when the plug cap 2*d* is axially pulled in a direction away from the main body 2*c*.

The base member 3 is an elongated plate like component, which is made of a dielectric resin material and detachably holds the ignition coils 2 at the corresponding positions that correspond to the positions of the plug holes 31 of the engine 30. The projections 3*a* project from a lower surface of the base member 3 in such a manner that the projections 3*a* are arranged at predetermined intervals in a longitudinal direction of the base member 3 (in the left-right direction in FIG. 1). The intervals of the projections 3*a* correspond to the intervals of the plug holes 31 of the engine 30, and the number of the projections. 3*a* is the same as the number of the plug holes 31 (i.e., the number of cylinders) or the number of the ignition coils 2. The outer diameter of each projection 3*a* is substantially the same as or is slightly larger than the inner diameter of the recess of the connector 2*b*. When the projections 3*a* are engaged with the corresponding recesses 2*f*, the ignition coils 2 are detachably engaged or connected to the base member 3. More specifically, the disengaging force for disengaging each ignition coil 2 and the base member 3 from each other through disengagement of the projection 3*a* and the recess 2*f* is set to be smaller than the disengaging force for disengaging each ignition coil 2 and the corresponding spark plug 32 from each other through disengagement between the plug cap 2*d* and the top end of the spark plug 32.

Furthermore, bolt receiving through holes 3*b* are provided at the longitudinal ends of the base member 3 at positions, which correspond to positions of bolt receiving blind holes 33 of the engine 30. Thus, the base member 3 is secured to the engine 30 by passing each of bolts 3*c* through the corresponding bolt receiving through hole 3*b* and threadably engaging the bolt 3*c* with threads of the corresponding bolt receiving blind hole 33.

Furthermore, the base member 3 includes internal wiring 4 embedded in the base member 3 to establish the electrical connection between the wiring 4 and the ignition coils 2. Also, the terminals 4*a* of the base member 3 are arranged at the positions, which correspond to the positions of the heads 2*a* of the ignition coils 2 installed to the base member 3, and are electrically connected to the internal wiring 4. When each terminal 4*a* is engaged with the terminal 2*e* of the ignition coil 2, there is established the electrical connection between the ignition coils 2 and the base member 3.

Next, installation of the ignition coil assembly 1 to the engine 30 and detachment of the ignition coils 2 from the engine 30 upon installation of the ignition coil assembly 1 to the engine 30 will be described with reference to FIGS. 1 to 4.

First, the installation of the ignition coil assembly 1 to the engine 30 will be described with reference to FIG. 1.

Each projection 3*a* of the base member 3 is engaged with the recess 2*f* of the connector 2*b* of the corresponding ignition coil 2, so that each ignition coil 2 is installed to the base member 3. In this way, each projection 3*a* is mechanically connected to the recess 2*f* of the corresponding ignition coil 2. Thus, unless each ignition coil 2 is forcefully pulled downward, each ignition coil 2 is not disengaged from the base member 3. Each terminal 4*a* of the base member 3 is engaged with the terminal 2*e* of the head 2*a* of the corresponding ignition coil 2 to electrically connect between each ignition coil 2 and the base member 3.

Next, upon installation of each ignition coil 2 to the base member 3, each ignition coil 2 is axially inserted into the corresponding plug hole 31 of the engine 30, and the top surface of the base member 3 is pressed downward (see FIG. 2). In this way, the top end of each spark plug 32 is fitted to the inner peripheral surface of the plug cap 2*d* of the corresponding ignition coil 2, so that the spark plug 32 and the ignition coil 2 are connected to each other. As described above, the ignition coils 2 are assembled together by the base member 3 and are arranged at the intervals that correspond to the intervals of the plug holes 31 of the engine 30. Thus, the ignition coils 2 can be installed to the engine 30 at once in a single step. As a result, an installation time period required to install the ignition coils 2 is reduced in comparison to the case where the ignition coils 2 are installed one by one.

Thereafter, the bolts 3*c* are inserted through the bolt receiving through holes 3*b* of the base member 3 and are threadably engaged with the bolt receiving holes 33 of the engine 30, thereby completing the installation of the ignition coil assembly 1 to the engine 30 (see FIG. 3).

Figure 4:
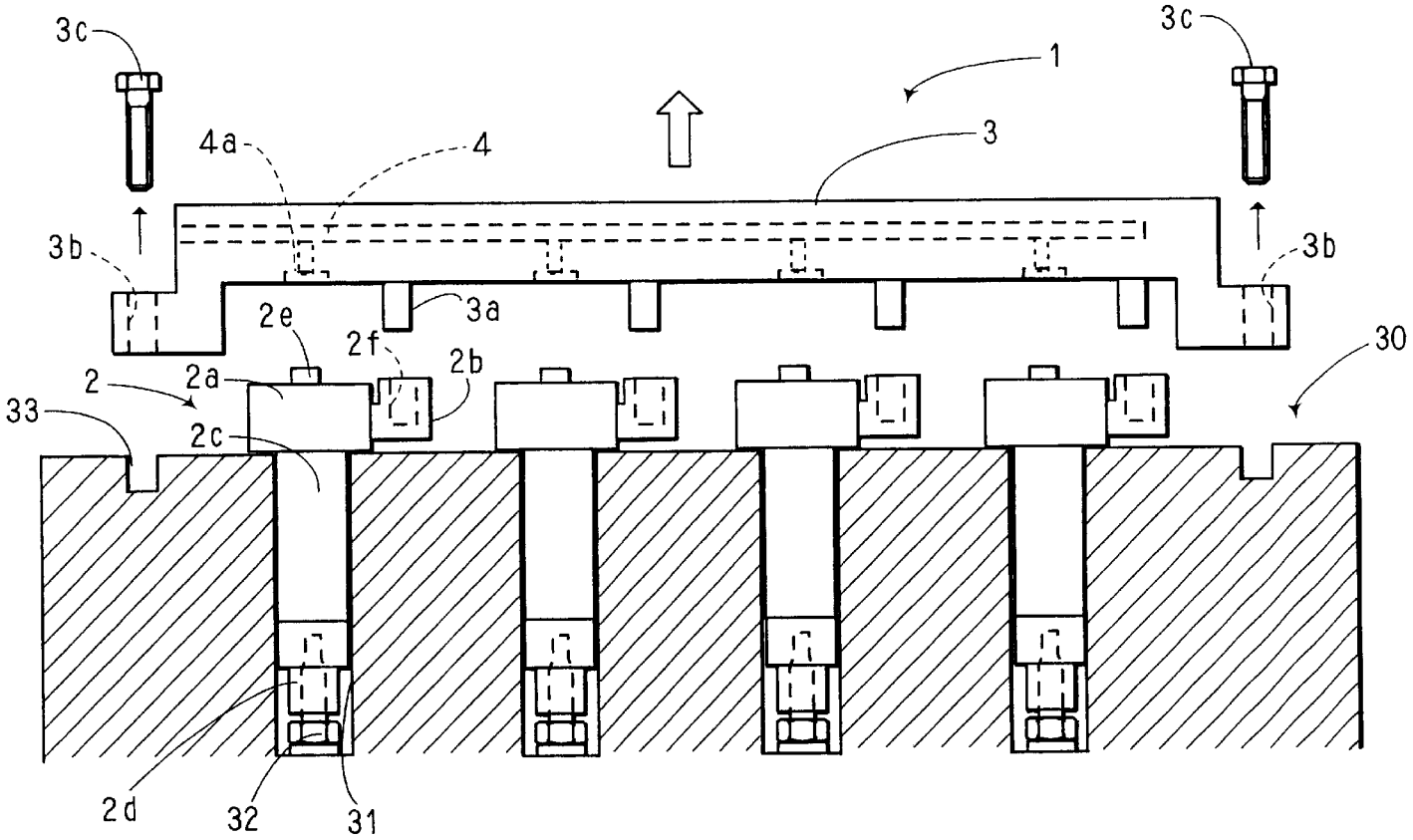
FIG. 4 is a schematic side view showing a state after disengagement of a base member from each ignition coil.

Next, detachment of the ignition coils 2 from the engine 30 upon installation of the ignition coil assembly 1 to the engine 30 will be described with reference to FIG. 4.

First, the bolts 3*c*, which are threadably secured at the longitudinal ends of the base member 3, are loosened and are removed from the base member 3.

Thereafter, the base member 3 is grasped and is pulled upward. At this time, the base member 3 is solely removed such that the base member 3 is disengaged from each ignition coil 2, and each ignition coil 2 is remained in the engine 30. That is, as described above, the disengaging force for disengaging each ignition coil 2 and the base member 3 from each other through disengagement of the projection 3*a* and the recess 2*f* is set to be smaller than the disengaging force for disengaging each ignition coil 2 and the corresponding spark plug 32 from each other through disengagement between the plug cap 2*d* and the top end of the spark plug 32. Thus, when the base member 3 is pulled upward, the mechanical connection between each ignition coil 2 and base member 3 is released while maintaining the mechanical connection between each ignition coil 2 and the corresponding spark plug 32.

After disengagement of the base member 3 from each ignition coil 2 and the sole removal of the base member 3 from the engine 30, the corresponding ignition coil(s) 2 and/or spark plug(s) 32, which require examination or replacement, can be removed from the engine 30 to perform the desired maintenance work.

It should be understood that the present invention is not limited to the above embodiment and can be embodied in various other ways.

Figure 5:
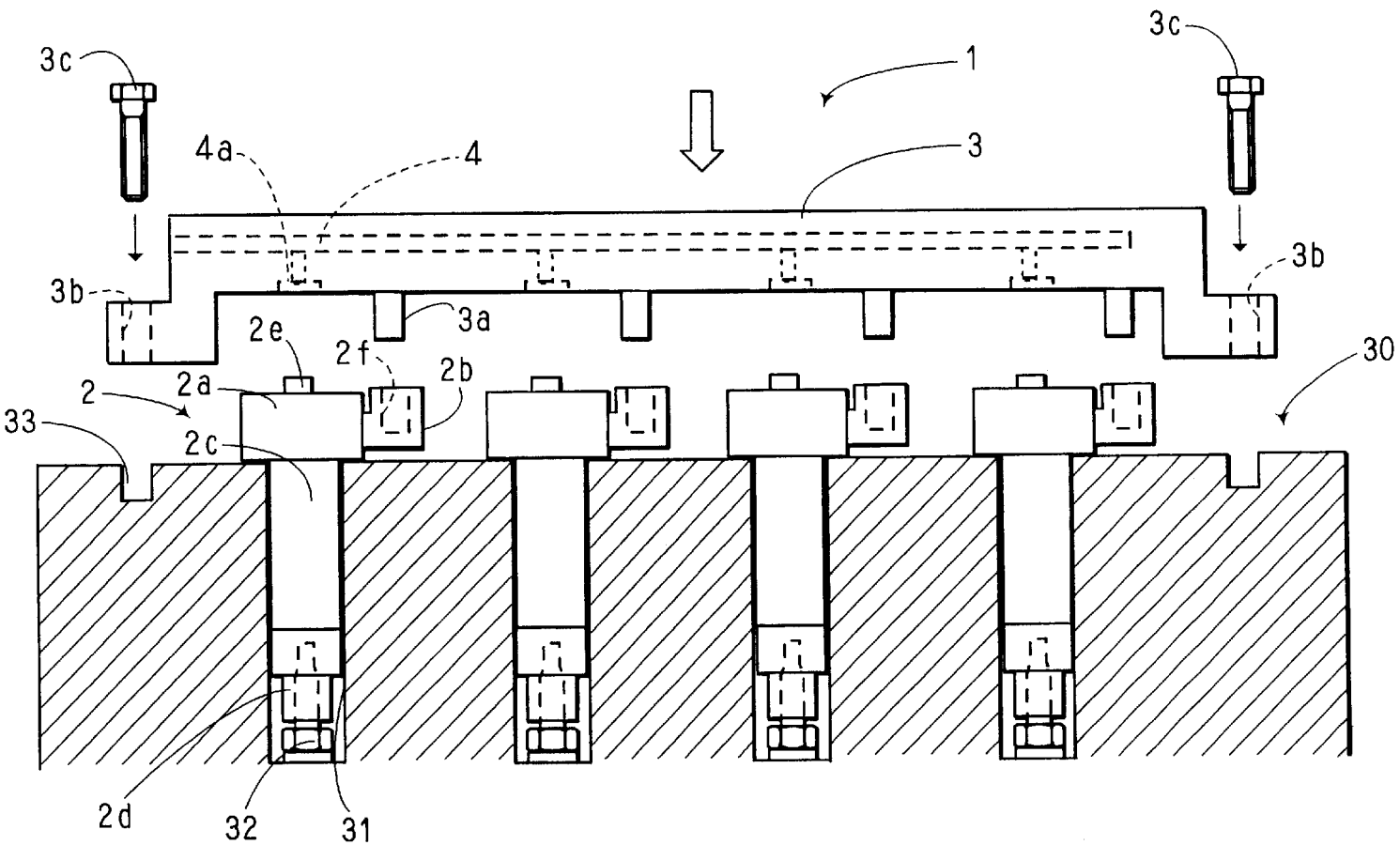
FIG. 5 is a schematic side view showing a modification of installation of the ignition coil assembly to the engine.

For example, in the above embodiment, the ignition coils 2 are installed to the engine 30 while the ignition coils 2 are previously installed to the base member 3. Alternatively, as shown in FIG. 5, the ignition coils 2 can be installed to the corresponding plug holes 31 of the engine 30 one after the other. Thereafter, the base member 3 can be urged downward against the installed ignition coils 2 to connect therebetween.

Figure 6:
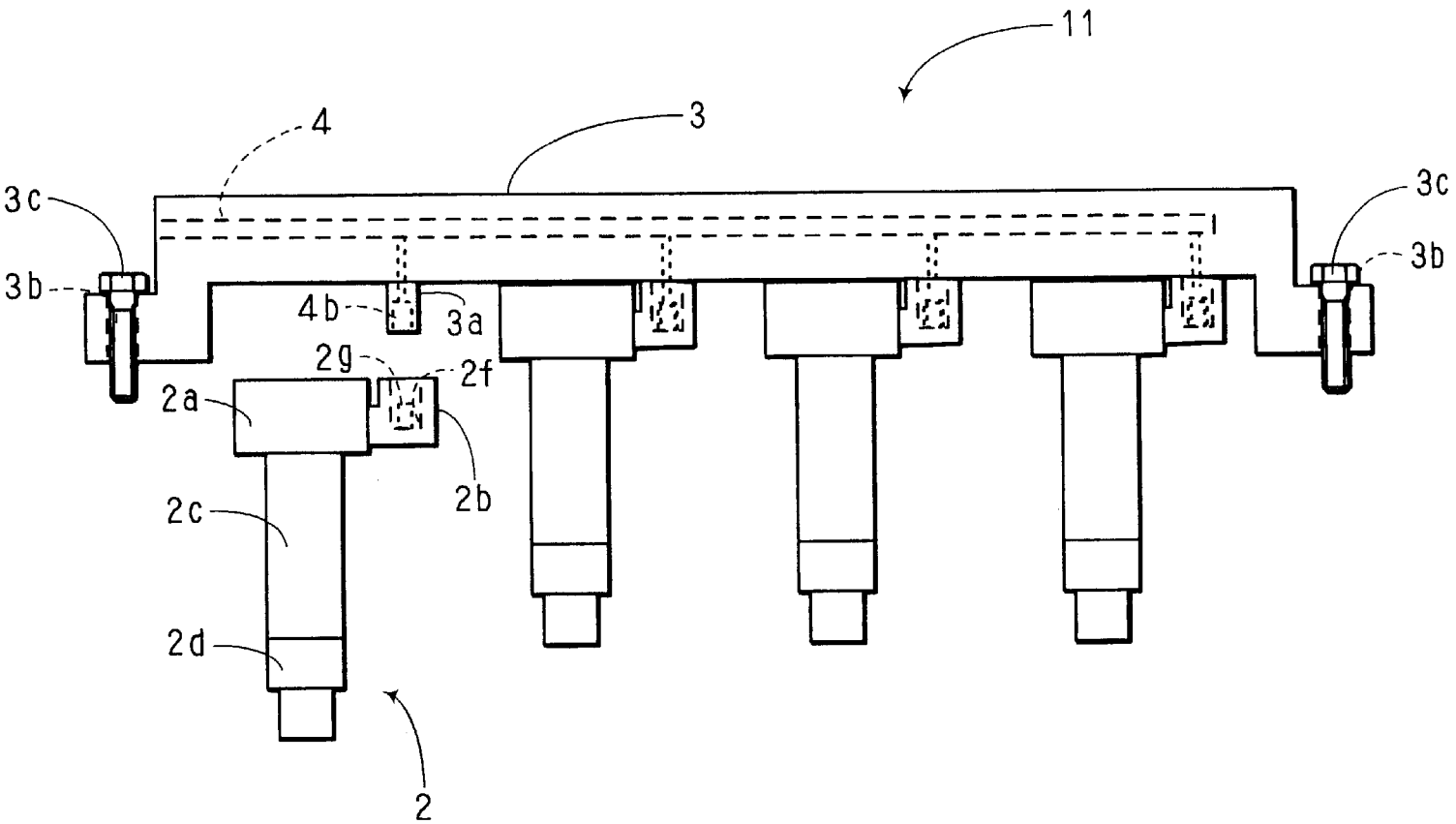
FIG. 6 is a schematic side view showing a modification of the ignition coil assembly.
Figure 7:
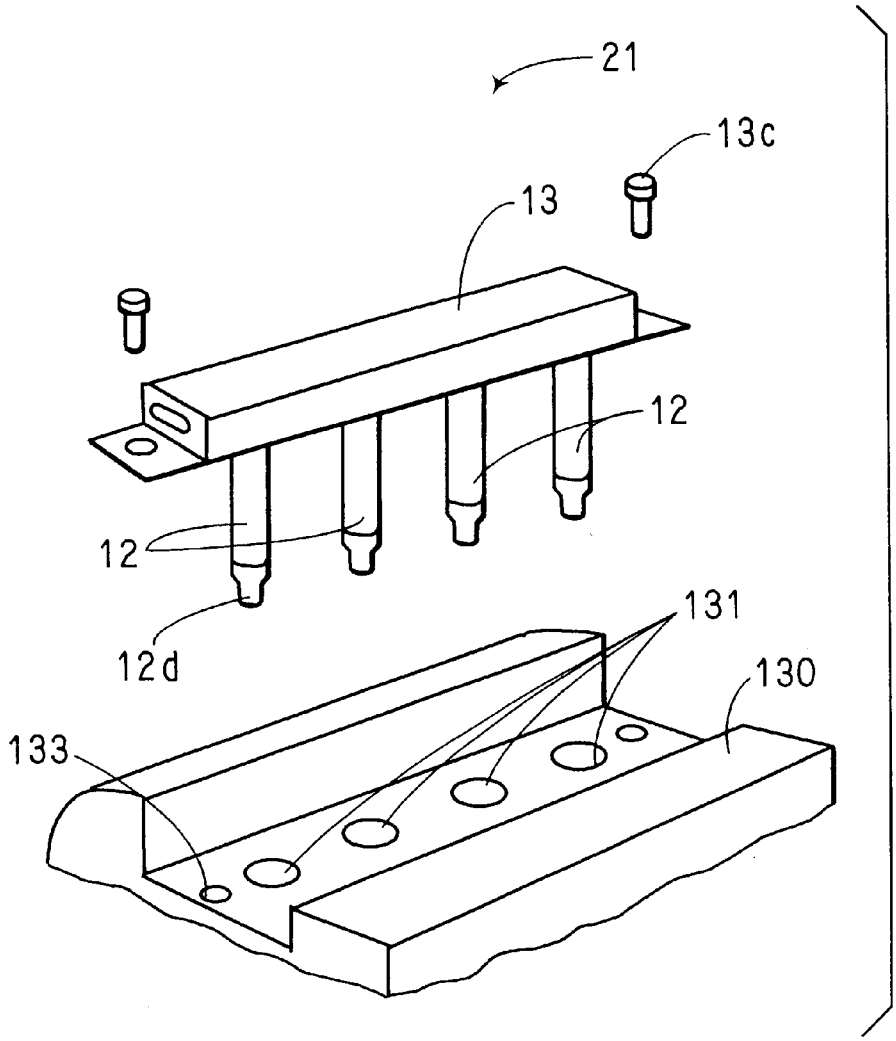
FIG. 7 RELATED ART
FIG. 7 is a schematic perspective view showing a previously proposed ignition coil assembly.

Furthermore, in the above embodiment, the terminal 2*e* is provided in the top surface of the head 2*a* of each ignition coil 2 to achieve the electrical connection with the corresponding terminal 4*a*. Alternatively, as shown in FIG. 6, a terminal 2*g*, which is similar to the terminal 2*e* and is provided in place of the terminal 2*e*, can be formed in the recess 2*f* of each connector 2*b*. Also, a terminal 4*b*, which is similar to the terminal 4*a* and is provided in place of the terminal 2*e*, can be formed in each projection 3*a* of the base member 3. With this arrangement, each spark plug 2 and the base member 3 are mechanically and electrically connected to each other through engagement between the connector 2*b* and the projection 3*a*.

Additional advantages and modifications will readily occur to those skilled in the art. The invention in its broader terms is therefore not limited to the specific details, representative apparatus, and illustrative examples shown and described.

What is claimed is:

1. An ignition coil assembly for an engine, wherein the engine includes a plurality of plug holes, each of which receives a corresponding one of a plurality of spark plugs, the ignition coil assembly comprising:

a plurality of ignition coils that are arranged to be electrically connected to the spark plugs, respectively; and a base member that detachably engages and holds the ignition coils at corresponding positions, which correspond to positions of the plug holes of the engine, wherein disengaging force for disengaging each ignition coil and the base member from each other is set to be smaller than disengaging force for disengaging each ignition coil and the corresponding one of the spark plugs from each other.

2. An ignition coil assembly according to claim 1, wherein:

a plurality of projections is provided in one of:

the base member; and the plurality of ignition coils, wherein a number of the projections is equal to a number of the ignition coils; and a plurality of recesses is provided in the other one of:

the base member; and the plurality of ignition coils, wherein a number of the recesses is equal to the number of the ignition coils, and each projection is engaged with a corresponding one of the recesses to establish connection between the base member and the corresponding one of the ignition coils.

3. An ignition coil assembly according to claim 2, wherein:

each of the projections includes an electrical terminal; and each of the recesses includes an electrical terminal that is electrically connected to the electrical terminal of a corresponding one of the projections to establish electrical connection between the base member and a corresponding one of the ignition coils.

* * * * *